United States Patent [19]

Wendelborn

[11] Patent Number: 4,998,683

[45] Date of Patent: Mar. 12, 1991

[54] SPOOL AND CORD TYPE SAFETY DEVICE

[76] Inventor: Hans Wendelborn, Luttkoppel 9 D-2361, Leezen, Fed. Rep. of Germany

[21] Appl. No.: 392,279

[22] Filed: Aug. 10, 1989

[51] Int. Cl.[5] ..... A62B 1/08; B65H 95/48

[52] U.S. Cl. ..... 242/99; 242/107.3; 242/107.4 B

[58] Field of Search ..... 242/107.4 B, 107.3, 242/99; 182/75, 237, 239, 232, 234; 254/376; 188/82.77, 135

[56] References Cited

U.S. PATENT DOCUMENTS

| | | | |
|---|---|---|---|
| 11,067 | 3/1890 | Griswold | 242/107.3 |
| 2,442,571 | 6/1948 | Ruddock | 242/107.3 |
| 2,791,397 | 5/1957 | Coffman | 242/107.4 B |
| 2,982,492 | 5/1961 | Spielman | 242/107.4 B |
| 2,990,131 | 6/1961 | Carlsson | 242/107.4 B |
| 3,430,891 | 3/1969 | Burleigh | 242/107.4 B X |
| 3,760,910 | 9/1973 | Koshihara | 182/237 X |
| 3,779,479 | 12/1973 | Lindblad | 242/107.4 B |
| 4,846,313 | 7/1989 | Sharp | 242/99 |

FOREIGN PATENT DOCUMENTS

| | | |
|---|---|---|
| 1229402 | 7/1969 | Fed. Rep. of Germany . |
| 2336148 | 12/1975 | France . |

OTHER PUBLICATIONS

DIN 23 326, Feb. 1982, Federal Republic of Germany.

*Primary Examiner*—John M. Jillions

*Attorney, Agent, or Firm*—Fleit, Jacobson, Cohn, Price, Holman & Stern

[57] ABSTRACT

A spool and cord type arresting device for use by persons to arrest a fall, has a spool rotationally mounted in a casing and a cord wound on the spool for paying out from the casing thereby rotating the spool. A pair of pawls are pivotally mounted on the spool for outward pivoting movement under centrifugal force responsive to rotation of the spool. The casing has a part circular track surrounding the spool and a slider mounted for travel around the track. The slider engages a compressible buffer element in the track. When the spool is rotated at a critical speed, the pawls pivot outwardly to an extended position and one of the pawls engages the slider thereby moving same around the track and compressing the buffer element until the spool is arrested by complete compression of the buffer element.

6 Claims, 1 Drawing Sheet

SPOOL AND CORD TYPE SAFETY DEVICE

BACKGROUND OF THE INVENTION

This invention relates to a safety device which may be used by climbers, construction workers or other persons working at height to arrest the person in case of a fall. The device is of the type in which a line or cord is payed out from a spool.

Generally, the protection offered by spool and cord type safety devices resides in that a person attached to the device cannot fall further than the length of the cord. Thus, if the cord is short enough, the gravitational acceleration over the distance available for the drop cannot result in a higher drop speed than such as would, even in case of sudden breaking and direct impact, cause at most painful bruising but certainly not serious bodily harm to the person falling. Therefore, in order to insure its safe functioning, the length of the cord should not exceed a certain limit.

The considerable restriction of movement of the secured person is eased in a safety device according to DAS 1,299,402 by the fact that the center of rotation of pawls on the spool inside the casing to which the cord is attached and around which it is coiled, are located in such a way that the centrifugal force created by the rotation of the spool extends the pawls and presses them against the teeth of a gear rim forming part of a friction brake.

Such a device allows the extension of the cord over any part of its length, as long as the cord extraction speed does not exceed a critical point at which the friction brake is activated and a slight braking occurs. However, the device is a rather complex construction and is rather heavy.

SUMMARY OF THE INVENTION

The present invention provides a simple and lightweight safety device which, in the case of the cord exceeding the adjustable critical extraction speed, does not cause a sudden stop, but reduces the gravitational speed gently to zero over a further, but not too long attenuation distance. This is achieved mainly through the fact that when the securing function starts to act, and pawls connected to the spool are extended, no friction brake is activated. Instead, the gravitational force is reduced through elastic distortion, i.e. it is transferred into heat.

Preferably, automatic retraction of the cord is provided by means of a retracting spring which is tensioned when the cord is pulled out of the casing.

During standstill and at low rotational speed of the spool, the pawls are retracted against it through a tractive force, for example a rubber band or traction spring. However, when a certain rotational speed is exceeded by the centrifugal force acting against the tractive force, the pawls are extended in such a way as to press against an obstacle, for example the wall of the casing, thus jamming the spool and preventing further extraction of the cord or line.

Since the rotational force at which this sudden braking occurs is determined by the tractive force with which the pawls are retracted, it can be ensured, by adjustment of this tractive force, that the braking and shock effect is set at a pull speed corresponding to a fall from a harmless height of say 0.3 to 0.5 meters.

In addition, after the start of the braking effect, no sudden stop of the fall movement occurs, but gravitational speed is reduced gently to zero over an additional, not too extended attenuating distance.

The gentle stabilization of the fall necessary to obtain this effect is achieved by the invention in that the gravitational power is eliminated through elastic deformation of a buffer element at the moment when the security function comes into action, i.e. when the pawls are extended sufficiently.

The invention is explained in more detail with reference to the attached drawings.

DESCRIPTION OF PREFERRED EMBODIMENT

Figure 1:
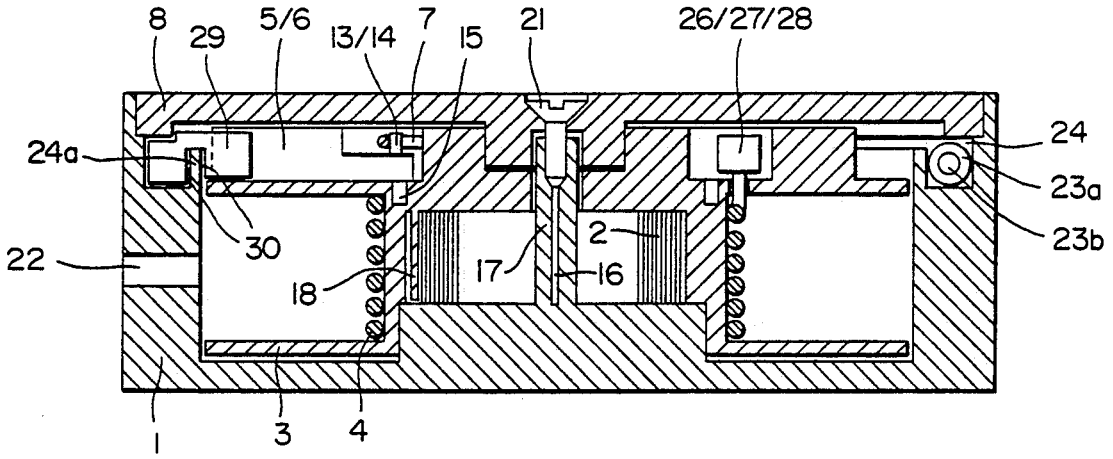
FIG. 1 is a sectional view of a safety device according to the invention taken on line I—I of FIG. 2.
Figure 2:
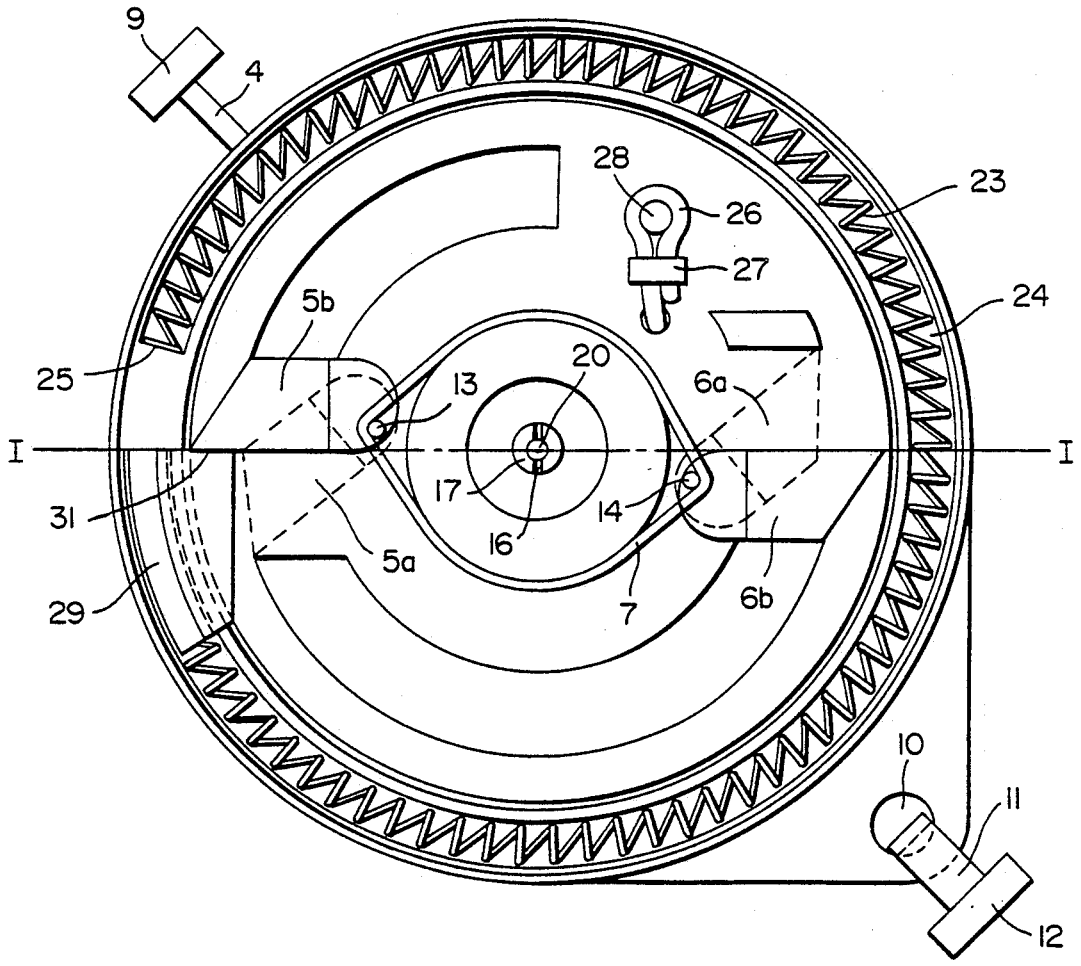
FIG. 2 is a plan view of the device with a cover removed.

In the drawings, reference numerical 1 represents a main body or casing of the device, 2 is a retraction spring and 3 is a spool on which a line or cord 4 is wound. The cord is preferably replaceable and made of synthetic material of high tensile strength. The spool has a pin 28 around which one end 26 of the cord is looped and secured by a collar 27, the other free end of the cord extending through an opening 22 in the casing and being provided with an attachment 9 for securing same to a fixture while the casing is attached to a user, or vice versa. An exchangeable cord allows a choice of material best suited to a given application, for example in respect of tensile strength or heat resistance, against certain chemicals and the like.

The spool has two opposed pawls 5 and 6 pivotally mounted to the spool on pins 15. Thus, when spool 3 rotates by cord 4 being payed out the pawls pivot outwardly or extend by centrifugal force. Outward pivoting of the pawls is resisted, however, by an endless traction element , such as a rubber band 7, which encircles respective pins 13, 14 on the pawls and pulls the pawls inwardly.

At standstill, the pawls are in respective retracted positions 5*a* and 6*a*.

Casing 1 has a peripheral circular groove or track 24 surrounding the spool, in which is mounted a slider 29 having a pawl-abutment face 31. Groove 24 has an inner flange 24*a* and slider 29 has an equivalent recess which fits on the flange. Inside groove 24 is an elongate compressible buffer element 23, one end of which engages the slider 29 and the other end of which engages an end wall 25 of the groove.

As the cord 4 is extended out from the casing, the initial position does not change much (except that the retraction spring 2 is tightened) so long as the extraction speed of the cord and thus rotational speed of the spool does not exceed the limit determined by the elasticity of rubber band 7. Pawls 5 and 6 may be extended slightly, but without touching the edge 31 of slider 33. However, once the critical rotational speed of spool 3 is reached, for example if the user falls, the pawls are extended sufficiently (position 5*b*, 6*b*) for one of the pawls to engage edge 31 of slider 29. The slider is then pressed against the buffer element 23 with continued rotation of the spool, thus compressing the buffer element along groove 24 and eventually preventing further rotation of the spool when the buffer element is fully compressed. The spool is not stopped suddenly, but it is slowed down gently through elastic compression of the buffer element. The maximum slowing down length is limited by the maximum compressibility of the buffer element.

The buffer element 23 may be a pressure spring or a rubber buffer. It preferably contains a spiral spring 23*a* with a rubber buffer 23*b* fitted inside.

The extending of the pawls 5 and 6, and thereby the commencement of the braking effect depends on the elasticity of the rubber band or tension spring 7. The extension speed at which braking takes place is also adjustable through the strength of the rubber band or tension spring 7, i.e. by exchanging same according to requirements.

When the tension of cord 4 decreases, the pawls 5 and 6 again retracted against the spool, the spool can rotate, and the cord can be further extended.

In a preferred construction of the invention, the spool 3, the casing 1 and cover 8 may be manufactured of smooth plastic, notably polyamide by injection molding. Thus, it is not necessary to use anti-friction bearings, widely used for similar spools, but to minimize the weight by using slide bearings for the spool. The cover 8 forms the counterpart to the coil pin 17 and prevents the pawls 5 and 6, the buffer 23, and the slider 29 from falling out of the groove 24.

The cover may be fastened to the main part of the casing 1 by glue, and/or by means of a self-tapping screw 21 in a central hole of pin 17.

What is claimed is:

1. A spool and cord type arresting device comprising a casing, a spool rotationally mounted in the casing, a cord wound on the spool for paying out from the casing thereby rotating the spool, at least one pawl pivotally mounted on the spool for outward pivoting movement under centrifugal force responsive to rotation of the spool, the pawl having an outer extended position to which it is moved when the spool attains a critical speed of rotation, a track in the casing at least partly surrounding the spool, a slider mounted for travel around the track, and a compressible buffer element in the track for engagement by the slider, the pawl being positioned for engaging the slider in said extended position and moving the slider around the track so as to compress the buffer element and arrest the spool.

2. A device according to claim 1 wherein the buffer element comprises a elongate spring-type element fitted in the track, said element having one end engaging an end wall of the track and an opposite end for engagement by the slider.

3. A device according to claim 1 wherein the track has an inner annular flange and the slide has an equivalent recess fitting on said flange.

4. A device according to claim 1 wherein the pawl has a traction element resisting said outward pivoting movement.

5. A device according to claim 4 wherein the traction element comprises an endless resilient band encircling a pin on the pawl for urging the pawl inwardly with respect to the spool.

6. A device according to claim 5 wherein the spool has a pair of pivoted pawls and the resilient band encircles pins on both said pawls.

* * * * *